US006382154B2

(12) United States Patent
Dietz et al.

(10) Patent No.: US 6,382,154 B2
(45) Date of Patent: May 7, 2002

(54) DEVICE FOR CHANGING THE TIMING OF INTAKE AND EXHAUST VALVES IN AN INTERNAL COMBUSTION ENGINE

(75) Inventors: Joachim Dietz, Frensdorf; Andreas Strauss, Forchheim, both of (DE)

(73) Assignee: INA Walzlager Schaeffler oHG, Herzogenaurach (DE)

( * ) Notice: Subject to any disclaimer, the term of this patent is extended or adjusted under 35 U.S.C. 154(b) by 0 days.

(21) Appl. No.: 09/813,385

(22) Filed: Mar. 21, 2001

(30) Foreign Application Priority Data

Mar. 21, 2000 (DE) ..... 100 13 877

(51) Int. Cl.[7] ..... F01L 1/344
(52) U.S. Cl. ..... 123/90.17
(58) Field of Search ..... 123/90.15, 90.17, 123/90.31

(56) References Cited

U.S. PATENT DOCUMENTS 5,301,639 A * 4/1994 Satou ..... 123/90.17
5,931,126 A * 8/1999 Eguchi et al. ..... 123/90.17
5,988,126 A * 11/1999 Strauss et al. ..... 123/90.17
6,116,200 A * 9/2000 Abts et al. ..... 123/90.17
6,129,060 A * 10/2000 Koda ..... 123/90.17
6,311,654 B1 * 11/2001 Ushida et al. ..... 123/90.17

FOREIGN PATENT DOCUMENTS

DE 19727667 A1 1/1999
DE 19745670 * 4/1999

* cited by examiner

*Primary Examiner*—Weilun Lo
(74) *Attorney, Agent, or Firm*—Volpe and Koenig, P.C.

(57) ABSTRACT

A device for changing the timing of valves in an internal combustion engine which includes a crankshaft-coupled component and a camshaft-coupled component is provided. The camshaft-coupled component is hydraulically rotatable and lockable with respect to the crankshaft-coupled component for relative rotation or hydraulic clamping of the camshaft (5) with respect to the crankshaft. Movement of hydraulic fluid to and from the device proceeds via a hydraulic-fluid adapter on the device's axial side facing away from the camshaft, against which adapter is additionally positioned an impulse-sending wheel for determining the camshaft position. The hydraulic-fluid adapter includes a diametrically expanded end flange which simultaneously forms the impulse-sending wheel of the device and, together with a washer positioned between the hydraulic-fluid adapter and the camshaft-coupled component that is likewise diametrically enlarged with respect to the hydraulic-fluid adapter, acts as the axial bearing of the camshaft.

4 Claims, 2 Drawing Sheets

DEVICE FOR CHANGING THE TIMING OF INTAKE AND EXHAUST VALVES IN AN INTERNAL COMBUSTION ENGINE

BACKGROUND

The present invention concerns a device for changing the timing of intake and exhaust valves in an internal combustion engine according to the features in the present invention, which is especially advantageous for hydraulic camshaft adjustment mechanisms.

Such a device is already generically known from German Patent Publication DE 197 45 670 A1. This device, essentially designed as a hydraulic servo-drive, is positioned at the drive-side end of a camshaft supported in the cylinder head of an internal combustion engine and consists of one component driven together with a crankshaft of the internal combustion engine as well as of another component rotationally connected with the camshaft. The camshaft-coupled component is hydraulically rotatable and lockable with respect to the crankshaft-coupled component and thus effects a relative rotation or a hydraulic clamping of the camshaft with respect to the crankshaft. The supply and withdrawal of hydraulic fluid to and from the device proceeds via a cylindrical hydraulic-fluid adapter positioned on the device's axial side facing away from the camshaft and attached to the camshaft-coupled component. This adapter includes several hydraulic-fluid lines running in the axial, radial, and circumferential direction and is supported in a sleeve bearing in the cylinder head of the internal combustion engine. The sleeve bearing is connected with the hydraulic-fluid circuit and is designed at the same time as the radial bearing of the camshaft. In addition, there is attached to the end wall of the hydraulic-fluid adapter, facing away from the camshaft, an impulse-sending wheel which cooperates with a suitable impulse-reading device and together with the latter serves in determining the camshaft position with respect to the crankshaft position during operation of the internal combustion engine.

In this known solution, however, it is disadvantageous that the required axial support of the camshaft connected with the device must be formed by a separate axial bearing on the camshaft so that precise machining of the camshaft and thus relatively high production costs are involved in its manufacture. In addition, such an axial bearing requires in connection with the impulse-sending wheel attached to the device an increased overall axial length of the camshaft and thus of the total cylinder head of the internal combustion engine, which, however, is frequently not possible due to the usually very restricted space conditions in the engine compartment of the vehicle.

SUMMARY

The present invention is directed to providing a device for changing the timing of intake and exhaust valves in an internal combustion engine in which the high production costs for an axial bearing on the camshaft as well as the overall axial length of the camshaft necessary for this axial bearing and for the impulse-sending wheel attached to the device can be reduced to a minimum.

This problem is solved according to the present invention for a device for changing the valve timing of an internal combustion engine by providing the hydraulic-fluid adapter on its end wall facing away from the camshaft with a diametrically expanded end flange which, on the one hand, simultaneously forms the impulse-sending wheel of the device and, on the other hand, is designed—together with a washer positioned between the hydraulic-fluid adapter and the component coupled to the camshaft and likewise diametrically enlarged with respect to the hydraulic-fluid adapter—as the axial bearing of the camshaft.

Alternatively, it is also possible to form the part of the axial bearing of the camshaft by the washer through a spacing ring fashioned on the axial side of the camshaft-coupled component facing away from the camshaft or through another diametrically expanded end flange positioned on the end wall of the hydraulic-fluid adapter facing the camshaft.

In appropriately refining this device according to the present invention, it is still further proposed that one can additionally position the head of the axial fastening bolt of the device at least partially in a countersink in the end wall of the hydraulic-fluid adapter facing away from the camshaft in order to still further reduce the overall axial length of the camshaft designed with the device. Proving especially advantageous here is the use of a fastening bolt having a hexagonal-socket-head which includes a diametrically enlarged collar and is positioned over about half of its axial length in the countersink of the hydraulic-fluid adapter.

The impulse-sending wheel formed by the end flange on the hydraulic-fluid adapter is designed in this case as a flat ring-shaped disk whose impulse marks are formed by notches or boreholes or the like distributed symmetrically or asymmetrically around its periphery or on its axial side and which cooperates with an impulse-reading device secured to the internal combustion engine and positioned axially to it.

It is also possible to solve the problem lying at the basis of the present invention involving a device for changing the timing of intake and exhaust valves by providing the impulse-sending wheel of the device attached to the end wall of the hydraulic-fluid adapter facing away from the camshaft with a greater diameter than the hydraulic-fluid adapter and—together with a washer positioned between the adapter and the camshaft-coupled component and likewise diametrically enlarged with respect to the hydraulic-fluid adapter—is simultaneously designed as the axial bearing for the camshaft.

In this case, it is also alternatively possible to form the part of the axial bearing of the camshaft formed by the washer through a spacing ring fashioned on the axial side of the camshaft-coupled component facing away from the camshaft or through a diametrically enlarged end flange positioned on the camshaft-facing end wall of the hydraulic-fluid adapter, as in the above-described embodiment.

As an appropriate refinement of the device according to the present invention, it is also possible to provide the impulse-sending wheel preferably as a cup-shaped sheet-metal piece which is separately attached by an additional nut to the head of the axial fastening bolt of the device such that it radially surrounds this nut. This special attachment of the impulse-sending wheel to the device has proven to be especially advantageous with regard to its consequently possible separate adjustability during assembly of the device to the camshaft of the internal combustion engine since then, with initially only lightly tightened fastening bolt, the required starting position of the camshaft-coupled component or the camshaft to the crankshaft-coupled component or the crankshaft can be adjusted and subsequently, with fully tightened fastening bolt, the impulse-sending wheel can be separately suitably adjusted. However, it would also be possible to secure the impulse-sending wheel to the hydraulic-fluid adapter with the axial fastening bolt of the device and to carry out simultaneously the adjustment of the camshaft-coupled component with respect to the crankshaft-coupled component of the device as well as the adjustment of the impulse-sending wheel. In the same way, it is also possible with the device according to the present invention to design the impulse-sending wheel as a flat ring-shaped disk and/or to position the head of the axial fastening bolt at least partially in a countersink in the hydraulic-fluid adapter in order to reduce the overall axial length of the camshaft designed with the device.

The preferably cup-shaped impulse-sending wheel of this device is provided as part of the axial bearing of the camshaft, which can also be fashioned with the same arrangement and action like a spoked wheel with angled spoke ends on the peripheral side, and furthermore includes at its periphery symmetrically or unsymmetrically distributed impulse marks designed as notches, boreholes, or the like and cooperates in this case with an impulse-reading device secured to the internal combustion engine and positioned radially to it.

Both of the devices according to the present invention thus exhibit, compared to the device known from the state of the art, the advantage that as a result of the integration of the axial bearing of the camshaft or the axial bearing of the camshaft and the impulse-sending wheel of the device in the components present in the device, it is no longer necessary to provide a special axial bearing for the camshaft. As a result, the production costs of a camshaft provided with such a device are considerably reduced in advantageous fashion. At the same time, the overall axial length of camshafts provided with these devices is reduced such that the devices of the present invention can also be used in internal combustion engines with very restricted space conditions in the engine compartment of the motor vehicle.

BRIEF DESCRIPTION OF THE DRAWINGS

The present invention is described in more detail below on the basis of two preferred embodiments. In the drawings.

DETAILED DESCRIPTION OF THE PREFERRED EMBODIMENTS

Figure 1:
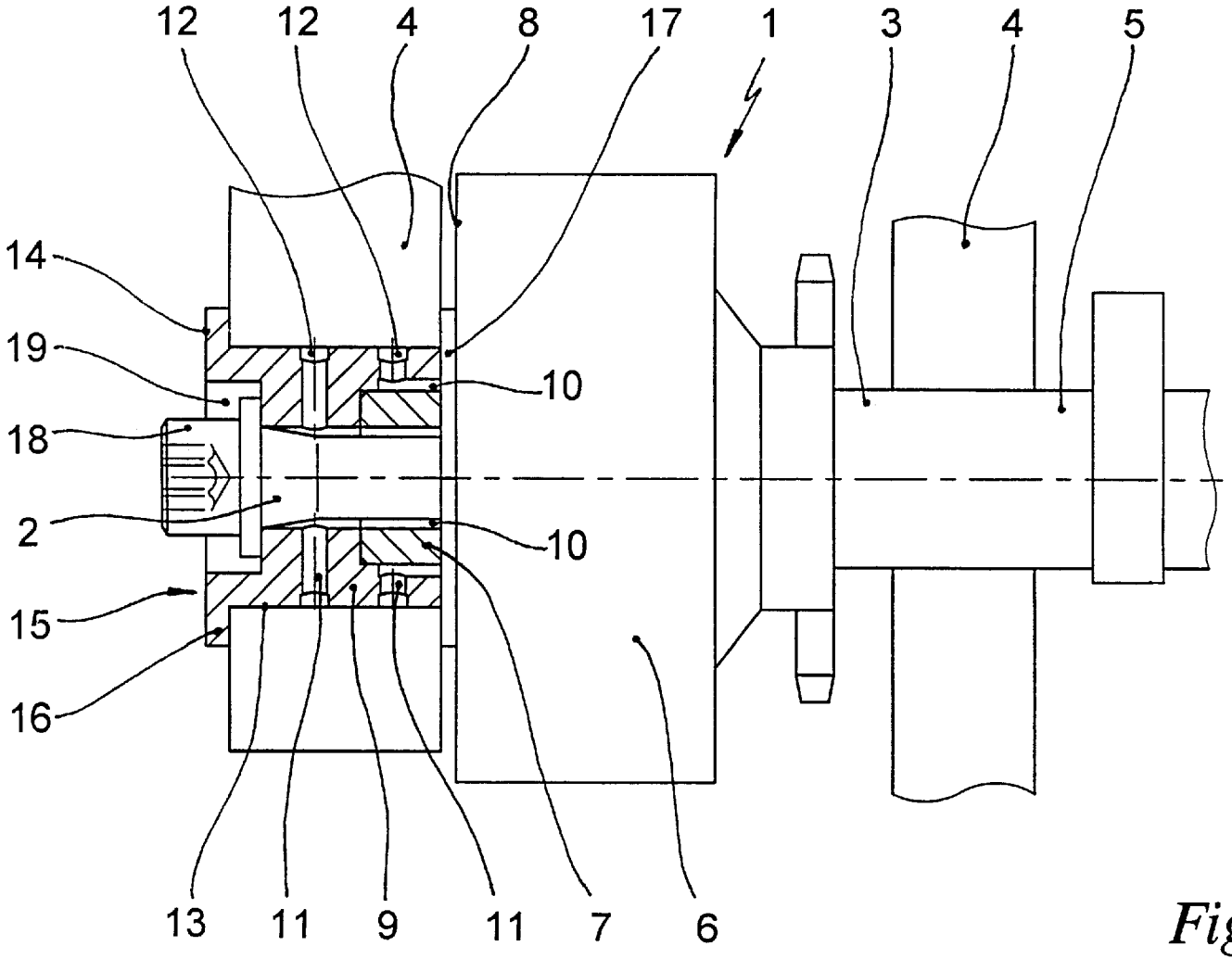
FIG. 1 is a top view of first device according to the present invention, the device being attached to a camshaft supported in the cylinder head of an internal combustion engine.
Figure 2:
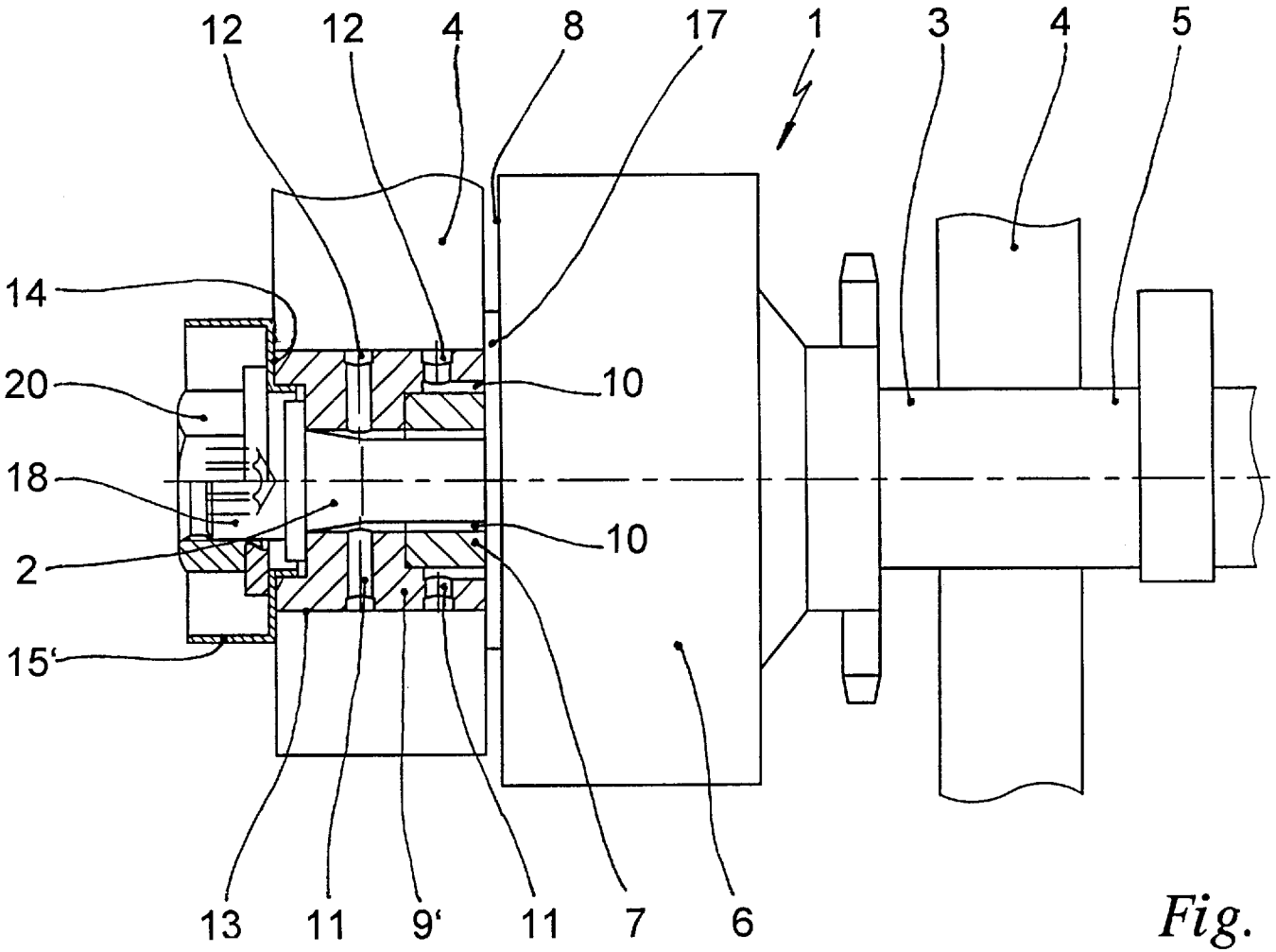
FIG. 2 is a top view of a second device according to the present invention, the device being attached to a camshaft supported in the cylinder head of an internal combustion engine.

FIGS. 1 and 2 show in each case the schematic representation of a device 1 for changing the timing of intake and exhaust valves in an internal combustion engine. The device is attached via an axial fastening bolt 2 to the drive-side end 3 of a camshaft 5 supported in the cylinder head 4 of the internal combustion engine and is designed essentially as a hydraulic servo-drive. Moreover, it is indicated in FIGS. 1 and 2 that device 1 includes a component 6 driven together with an unshown crankshaft of the internal combustion engine and coupled therewith and a camshaft-coupled component 7 rotationally secured with the camshaft 5 and hydraulically rotatable and lockable with respect to the crankshaft-coupled component 6 and thus capable of effecting a relative rotation or hydraulic clamping of the camshaft 5 with respect to the crankshaft. The supply and withdrawal of hydraulic fluid to and from the device 1 proceeds here via a cylindrical hydraulic-fluid adapter 9,9' positioned on the device's axial side 8 facing away from the camshaft and attached to the camshaft-coupled component 7. The adapter includes several hydraulic-fluid lines 10, 11, 12 running in the axial, in the radial, and in the circumferential direction, and is supported in a sleeve bearing 13 in the cylinder head 4 of the internal combustion engine, which bearing is connected with the hydraulic-fluid circuit and is designed at the same time as the radial bearing of the camshaft 5. In addition, as is indicated in each of the figures, the device 1 includes on the end wall 14 of the hydraulic-fluid adapter 9,9' facing away from the camshaft, an impulse-sending wheel 15,15' positioned axially to the camshaft 5, which wheel cooperates during operation of the internal combustion engine with an unshown impulse reading unit in determining the camshaft position with respect to the crankshaft position.

In order to lower the high production costs for a separate axial bearing for the camshaft 5 and in order simultaneously to reduce the overall axial length of the camshaft 5 designed with the device 1, the hydraulic-fluid adapter 9 of the device 1 shown in FIG. 1 includes according to the present invention on its end wall 14 facing away from the camshaft a diametrically expanded end flange 16 which, on the one hand, simultaneously forms the impulse-sending wheel 15 of device 1 and, on the other hand, is designed—together with a washer 17 positioned between the hydraulic-fluid adapter 9 and the camshaft-coupled component 7 and likewise diametrically enlarged with respect to the hydraulic-fluid adapter 9—as the axial bearing of camshaft 5. As is clearly recognizable from FIG. 1, the head 18 of axial fastening bolt 2 of device 1 is additionally partially positioned here in a countersink 19 in the end wall 14 of the hydraulic-fluid adapter 9 facing away from the camshaft in order to further reduce the overall axial length of the camshaft 5 used with the device.

In the case of the device 1 shown in FIG. 2, in contrast, the impulse-sending wheel 15' positioned on the end wall 14 of hydraulic-fluid adapter 9' facing away from the camshaft includes according to the present invention a larger diameter than the hydraulic-fluid adapter 9' which in reduce the production costs associated with a separate axial bearing for camshaft 5 so that it is designed—together with a washer 17 likewise positioned between the adapter and the camshaft-coupled component 7 and likewise diametrically enlarged with respect to the hydraulic-fluid adapter 9'—as the axial bearing of camshaft 5. The impulse-sending wheel 15' is provided here, as is clear from FIG. 2, as a cup-shaped sheet-metal part which is separately attached by an additional nut 20 to the head 18 of the axial fastening bolt 2 of device 1 and radially surrounds nut 20.

ELEMENT NUMBERS

1 device
2 fastening bolt
3 drive-side end
4 cylinder head
5 camshaft
6 crankshaft-coupled component
7 camshaft-coupled component
8 axial side facing away from the camshaft
9 hydraulic-fluid adapter
9' hydraulic-fluid adapter
10 hydraulic-fluid lines
11 hydraulic-fluid lines
12 hydraulic-fluid lines
13 sleeve bearing
14 end wall facing away from the camshaft
15 impulse-sending wheel
15' impulse-sending wheel

16 end flange
17 washer
18 bead
19 countersink
20 nut

What is claimed is:

1. Device for changing the timing of intake and exhaust valves in an internal combustion engine of the hydraulic servo-drive type comprising:

at least one axial fastening bolt (2) for connecting the device (1) to a drive-side end (3) of a camshaft (5) supported in the cylinder head (4) of the internal combustion engine;

a crankshaft-coupled component (6) driven together with a crankshaft of the internal combustion engine and a camshaft-coupled component (7) rotationally connected with the camshaft (5);

the camshaft-coupled component (7) is hydraulically rotatable and lockable with respect to the crankshaft-coupled component (6) to effect a relative rotation or a hydraulic clamping of the camshaft (5) with respect to the crankshaft;

a cylindrical hydraulic-fluid adapter (9,9') positioned on the device's axial side (8) facing away from the camshaft for supplying and withdrawing hydraulic fluid to and from the device (1) attached to the camshaft-coupled component (7);

the hydraulic-fluid adapter (9) includes a plurality of hydraulic-fluid lines (10, 11, 12) and is supported in a sleeve bearing (13) in or on the cylinder head (4) of the internal combustion engine, the bearing being part of a hydraulic-fluid circuit and simultaneously acting as a radial bearing of the camshaft (5);

an impulse-sending wheel (15,15') for determining the camshaft position with respect to the crankshaft position connected to an end wall (14) of the hydraulic-fluid adapter (9,9') facing away from the camshaft axially to the camshaft (5);

a diametrically expanded end flange (16) is connected to the end wall (14) of the hydraulic-fluid adapter (9) facing away from the camshaft which simultaneously forms the impulse-sending wheel (15) of the device (1) and, together with a washer (17) positioned between the hydraulic-fluid adapter (9) and the camshaft coupled component (7) which is diametrically enlarged with respect to the hydraulic-fluid adapter (9), an axial bearing for the camshaft (5).

2. Device according to claim 1, wherein the axial fastening bolt (2) of the device (1) includes a head (18) that is positioned at least partially in a countersink (19) in the end wall (14) of the hydraulic-fluid adapter (9) facing away from the camshaft.

3. Device for changing the timing of intake and exhaust valves in an internal combustion engine of claim 1, wherein the impulse-sending wheel (15') of the device (1) is positioned against the end wall (14) of the hydraulic-fluid adapter (9') facing away from the camshaft has a greater diameter than the hydraulic-fluid adapter (9') and, together with the washer (17) positioned between the adapter and the camshaft-coupled component (7), acts as the axial bearing for the camshaft (5).

4. Device according to claim 3, wherein the impulse-sending wheel (15') is a cup-shaped sheet-metal piece which is separately attached by an additional nut (20) to a head (18) of the axial fastening bolt (2) of the device (1) and radially surrounds the nut (20).

* * * * *